US005943534A

United States Patent [19]

Watanabe

[11] Patent Number: 5,943,534

[45] Date of Patent: Aug. 24, 1999

[54] IMAGE FORMING METHOD AND APPARATUS INCLUDING A LIQUID DEVELOPER CAPABLE OF CHANGING IN SURFACE TENSION

[75] Inventor: Mitsuyoshi Watanabe, Inazawa, Japan

[73] Assignee: Brother Kogyo Kabushiki Kaisha, Nagoya, Japan

[21] Appl. No.: 08/974,383

[22] Filed: Nov. 19, 1997

[30] Foreign Application Priority Data

Nov. 21, 1996 [JP] Japan ..... 8-310767

[51] Int. Cl.[6] ..... G03G 15/10

[52] U.S. Cl. ..... 399/237; 399/238; 399/239

[58] Field of Search ..... 399/237, 238, 399/239, 240, 241, 242, 243, 244, 245, 246, 247, 248, 133, 154; 430/117, 118, 119, 112, 113, 114, 115, 116

[56] References Cited

U.S. PATENT DOCUMENTS

| | | | |
|---|---|---|---|
| 5,610,694 | 3/1997 | Lior et al. | 399/240 |
| 5,622,805 | 4/1997 | Uehara et al. | 430/117 |
| 5,761,594 | 6/1998 | Seto et al. | 399/302 |

FOREIGN PATENT DOCUMENTS

A 8-156401 6/1996 Japan .

OTHER PUBLICATIONS

Japanese Abstract—Higuchi et al—JP–406092006A, Apr. 1994.

*Primary Examiner*—Richard Moses
*Assistant Examiner*—Shival Virmani
*Attorney, Agent, or Firm*—Oliff & Berridge, PLC

[57] ABSTRACT

An image forming method and a image forming apparatus which make use of a liquid developer capable of changing in surface tension upon exposure or heating. The liquid developer is fed to the surface of a developer holding means on the surface of which the liquid developer to holdable, the surface of the developer holding means on which the liquid developer is held is subjected to selective exposure or heating in accordance with image information to form a latent image, and the latent image is transferred to a recording medium to form a visible image. This method and apparatus make it possible to form highly minute images at a high speed, and promise a high reliability and a low power consumption.

20 Claims, 7 Drawing Sheets

IMAGE FORMING METHOD AND APPARATUS INCLUDING A LIQUID DEVELOPER CAPABLE OF CHANGING IN SURFACE TENSION

BACKGROUND OF THE INVENTION

1. Field of the Invention

This invention relates to an image forming method and an image forming apparatus which are used in printers, copying machines and so forth.

2. Description of the Related Art

In conventional image forming apparatus such as printers and copying machines, techniques such as ink-jet recording, thermal transfer and electrophotography are used. In particular, when used to form images at a high speed and in a high minuteness, apparatus employing electrophotographlc techniques are widely used.

Electrophotographic systems, however, have a complicated process and require high-voltage power sources for their charging assemblies. They also have had problems on environment, e.g., the generation of ozone due to corona discharge. In addition, they require a large energy to fix toners, and hence have also had a problem of a large power consumption.

To solve these problems, as disclosed, e.g., in Japanese Patent Application Laid-open No. 8-156401, an image forming method is proposed in which a polar reversible medium capable of reversible hydrophilic-hydrophobic conversion is provided on the surface of a drum and is selectively hydrophilic-hydrophobic switched by exposure (irradiation with light) or heating to control the adhesion of liquid ink. According to this method, the liquid ink to caused to selectively adhere to the drum surface in accordance with image information without use of electric fields, and hence the problems in electrophotographic techniques can be solved.

Since, however, the polar reversible medium is used in the above image forming method in order to form images by selectively hydrophilic-hydrophobic changing the drum surface, there has been a problem that the medium tends to deteriorate as a result of repeated use and may become not achievable of the desired properties because of changes with time. Also, the polar reversible medium capable of reversible hydrophilic-hydrophobic conversion has a narrow range of materials selection, and there has been a possibility of a high cost. Since also the hydrophllic-hydrophobic conversion of the surface is utilized, there has been a possibility that the system tends to be affected by drum surface contamination or adhesion of developer to become unstable.

SUMMARY OF THE INVENTION

The present invention was made in order to solve the above problems. Accordingly, an object of the present invention is to provide an image forming method and an image forming apparatus that have no environmental problems, have a high reliability and a small power consumption, and can form images at a high speed and in a high minuteness.

To achieve this object, the present invention provides an image forming method comprising;

feeding a liquid developer capable of changing in surface tension upon exposure (irradiation with light) or heating, to the surface of a developer holding means on the surface of which the liquid developer is holdable;

forming a latent image on the surface of the developer holding means on which the liquid developer is held, by subjecting the surface to selective exposure or heating in accordance with image information; and transferring the latent image to a recording medium to form a visible image.

The present invention also provides an image forming apparatus comprising;

a developer holding means on the surface of which a liquid developer capable of changing in surface tension upon exposure or heating is holdable;

a liquid developer feeding means for feeding the liquid developer to the surface of the developer holding means;

a latent image forming means for forming a latent image on the surface of the developer holding means on which the liquid developer is held, by subjecting the surface to selective exposure or heating in accordance with image information; and a transfer means for transferring the latent image formed on the surface of the developer holding means, to a recording medium to form a visible image.

This and other objects, features and advantages of the present invention are described in or will become apparent from the following detailed description of the invention.

DETAILED DESCRIPTION OF THE INVENTION

Figure 1:
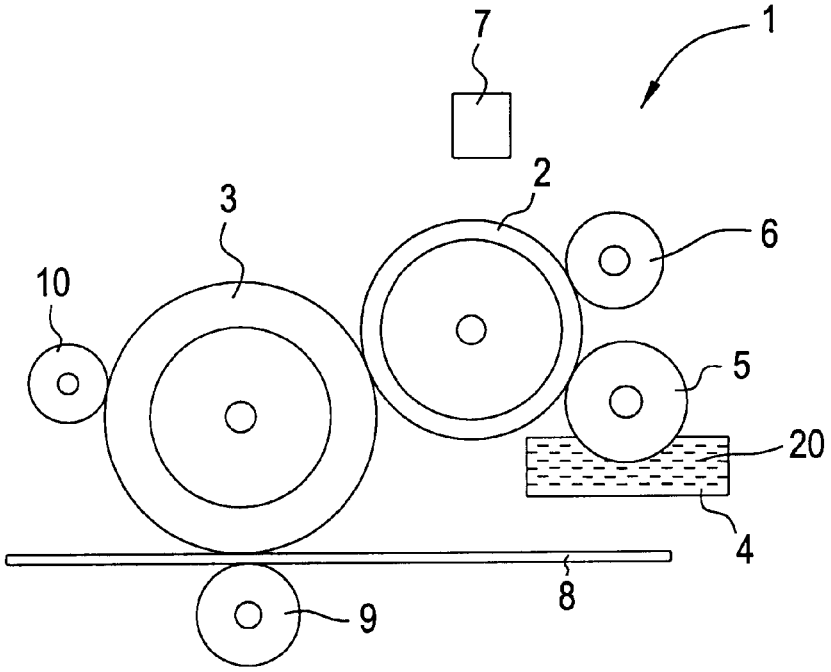
FIG. 1 schematically illustrates the constitution of the image forming apparatus according to an embodiment of the present invention.

According to the image forming method of the present invention, a liquid developer capable of changing in surface tension upon exposure (irradiation with light) or heating is fed to the surface of a developer holding means on the surface of which the liquid developer is holdable, the surface of the developer holding means on which the liquid developer is held is subjected to selective exposure or heating in accordance with image information to form a latent image on the surface, and the latent image is transferred to a recording medium to form a visible image.

In the present image forming method, the liquid developer may contain a component capable of causing a change in steric configuration of molecules upon exposure or heating. Use of such a developer is preferable because the latent image can be formed by changing steric configuration of molecules of the liquid developer when the surface of the developer holding means on which the liquid developer is held is subjected to selective exposure or heating in accordance with image information.

In the present image forming method, the liquid developer may contain a component capable of releasing hydroxide ions or hydrogen ions to cause a change in pH upon exposure or heating and a component capable of changing in surface tension as a result of the change in pH. Use of such a developer is preferable because the latent image can be formed by releasing hydroxide ions or hydrogen ions contained in the liquid developer, to cause a change in pH and to cause a change in surface tension as a result of the change in pH when the surface of the developer holding means on which the liquid developer is held is subjected to selective exposure or heating in accordance with image information.

In the present image forming method, the liquid developer may contain a component capable of cis-trans rearrangement to cause a change in surface tension upon exposure or heating. Use of such a developer is preferable because the latent image can be formed by causing cis-trans rearrangement to cause a change in surface tension of the liquid developer when the surface of the developer holding means on which the liquid developer is held is subjected to selective exposure or heating in accordance with image information.

According to the image forming apparatus of the present invention, a liquid developer feeding means feeds the liquid developer to the surface of a developer holding means on the surface of which a liquid developer capable of changing in surface tension upon exposure or heating is holdable, a latent image forming means forms a latent image on the surface of the developer holding means on which the liquid developer is held, by subjecting the surface to selective exposure or heating in accordance with image information, and a transfer means transfers the latent image formed on the surface of the developer holding means, to a recording medium to form a visible image.

In the present image forming apparatus, the latent image forming means may be so constituted as to cause a change in surface tension of the liquid developer hold on the surface of the developer holding means, to change the shape of droplets. This is preferable because the latent image forming means can form the latent image by changing the surface tension of the liquid developer held on the surface of the developer holding means.

In the present image forming apparatus, the transfer means may have an intermediate transfer member provided between the developer holding means and the recording medium, disposed so as to come into contact with or come near to the surface of the developer holding means, and is so constituted as to receive as an intermediate transfer image the latent image formed on the surface of the developer holding means and to transfer the received intermediate transfer image to the recording medium. This is preferable because the intermediate transfer member can receive the latent image formed on the surface of the developer holding means and transfer the received intermediate transfer image to the recording medium.

In the present image forming apparatus, the developer holding means and the intermediate transfer member may be formed of materials having different surface tension (or surface energy) from each other at their surface portions. This is preferable because the surface tension of the liquid developer held on the surface of the developer holding means changes from a state close to the surface tension of the developer holding means surface to a state close to the surface tension of the intermediate transfer member surface upon exposure or heating, and hence the latent image can be transferred to the intermediate transfer member in the state of a higher adhesion to the intermediate transfer.

In the present image forming apparatus, an electric-field applying member for applying an electric field across the developer holding means and the intermediate transfer member may be provided. This is preferable because the adhesion of the liquid developer held on the surface of the developer holding means can be made higher and the liquid developer can be transferred more efficiently to the intermediate transfer member.

In the present image forming apparatus, numerous micropores in which the liquid developer is holdable may be formed on the surface of the developer holding means. This is preferable because the liquid developer can be held dividedly in the individual micropores.

In the present image forming apparatus, the developer holding means may be provided with a projection for forming a space that keeps a certain distance between the liquid surface of the liquid developer held in the micropores and the surface of the developer holding means. This is preferable because the liquid surface of the liquid developer held in the micropores and the surface to which it is transferred can be kept at a given distance and only the liquid developer whose droplets have changed in shape can be surely transferred.

In the present image forming apparatus, the numerous micropores may be formed in the form of through-holes. This is preferable because the liquid developer can be held in the numerous micropores without causing air bubbles.

In the present image forming apparatus, the numerous micropores may be formed in the form of tapered-holes expanded on their surface side. This is preferable because the shape of droplets of the liquid developer can be greatly changed and the liquid developer having been exposed or heated can be more surely transferred.

In the present image forming apparatus, a warm means for keeping the temperature of the liquid developer held on the surface of the developer holding means may be provided. This is preferable because the warm means can keep the temperature of the liquid developer and the changes in surface tension of the liquid developer can be accelerated.

In the present image forming apparatus, the latent image forming means may comprise an exposure means so constituted as to selectively expose the surface of the developer holding means in accordance with image information. This is preferable because the surface of the developer holding means can be selectively exposed in accordance with image information.

In the present image forming apparatus, the exposure means may comprise a laser light scanner that scan with laser light. This is preferable because the laser light scanner can selectively expose the surface of the developer holding means in accordance with image information.

In the present image forming apparatus, the exposure means may comprise an LED (light-emitting diode) line head with numerous LEDs arranged in lines. This is preferable because the LED line head can selectively turns on the LEDs in accordance with image information to thereby selectively expose the surface of the developer holding means.

In the present image forming apparatus, the exposure means may comprise a liquid-crystal shutter and a back light for liquid crystal. This is preferable because the liquid-crystal shutter can selectively transmits the light of the back light for liquid crystal in accordance with image information to thereby selectively expose the surface of the developer holding means.

In the present image forming apparatus, the latent image forming means may comprise a heating means for selectively heating the surface of the developer holding means in accordance with image information. This is preferable because the heating means can selectively heat the surface of the developer holding means in accordance with image information.

In the present image forming apparatus, the heating means comprises a thermal head. This is preferable because the thermal head can selectively heat heating elements in accordance with image information to thereby selectively heat the surface of the developer holding means.

Specific embodiments of the present invention will be described below with reference to the accompanying drawings.

First, an image forming apparatus 1 according to an embodiment of the present invention is constituted as described below with reference to FIG. 1.

The image forming apparatus is constituted of a developer roller 2 that holds on its surface a developer 2 which is a liquid capable of changing in surface tension upon exposure, an image forming drum 3 provided opposingly to the developer roller 2 and standing in proximity to the developer roller 2 leaving a certain gap between them, a developer container 4 reserving a developer 20, a feeding roller 5 one part of which is immersed in the developer 20 in the developer container 4 and the other of which is provided in proximity to the developer roller 2 to feed the developer 20 to the surface of the developer roller 2, a doctor roller 6 provided rotatably in proximity to the developer roller 2 to adjust to an appropriate quantity the developer 20 fed to the surface of the developer roller 2, a selective exposure device 7 provided opposingly to the developer roller 2 to selectively expose the developer 20 held on the surface of the developer roller 2, a transfer roller 9 provided rotatably in contact with the image forming drum 3 to transfer to a recording material 8 the image formed on the image forming drum 3, and a cleaning roller 10 provided rotatably in contact with the image forming drum 3 to remove the developer 20 not transferred to the recording material 8 and remaining on the image forming drum 3.

Here, the developer 20 constitutes the liquid developer of the present invention; the developer roller 2, the developer holding means; the image forming drum 3, the intermediate transfer member; the developer container 4 and the feeding roller 5, the developer feeding means; the selective exposure device 7, the latent image forming means; the recording material 8, the recording medium; and the image forming drum 3 and the transfer roller 9, the transfer means.

The image forming apparatus 1 constituted as described above is operated in the manner as described below.

As the feeding roller 5 immersed in the developer 20 reserved in the developer container 4 is rotated, the developer 20 is held on the surface of the feeding roller 5 and transported. Since the feeding roller 5 is provided in proximity to the developer roller 2, the developer 20 held on the surface of the feeding roller 5 is moved to the surface of the developer roller 2 at the nip between the feeding roller 5 and the developer roller 2. The surface of the developer roller 2 has, as will be detailed later, a porous structure, where micropores 11 formed on the surface are filled with the developer 20.

Next, the developer 20 moved to the surface of the developer roller 2 is, as the developer roller 2 is rotated, transported to the nip between it and the doctor roller 6. The doctor roller 6 is rotated in proximity to the developer roller 2 while maintaining the certain gap between them. It removes any excess developer 20 present on the developer roller 2 and adjusts to an appropriate quantity the developer 20 on the surface of the developer roller 2. Thus, the surface of the developer roller 2 is brought into a state where the developer 20 is held in only the micropores 11.

Next, the developer 20 held in the micropores 11 is as the developer roller 2 is rotated, further transported to the selective exposure position. Here, the developer 20 held in the micropores 11 is selectively exposed by means of the selective exposure device 7 in accordance with image information, i.e., image signals, sent from a control unit (not shown).

Here, the selective exposure device 7 is constituted like the one used in usual laser printers, and is commonly constituted of a semiconductor laser and a scanning device such as a polygon scanner that scans with the light emitted from the semiconductor laser. Of course, an LED array with LEDs arranged in arrays may be used. Alternatively, an assembly may be used which is constituted of a liquid crystal shutter and a back light for liquid crystal so as to selectively transmit the light of the back light for liquid crystal.

Once the developer 20 is selectively exposed by means of the selective exposure device 7, only the developer 20 thus exposed undergoes a change in surface tension. The developer 20 having changed in surface tension moves to the surface of the image forming drum 3 at the nip between the developer roller 2 and the image forming drum 3, and the developer 20 having not changed in surface tension remains as it is on the developer roller 2. In this way, only the developer 20 exposed to light is transferred to the surface of the image forming drum 3, thus the desired image is formed on the image forming drum 3. The developer 20 on the image forming drum 3 is transported as the image forming drum 3 is rotated, and transferred onto the recording material 8 at the nip between the image forming drum 3 and the transfer roller 9. The recording material 8 is transported by the transfer roller 9, and a final output imaged is obtained. The developer 20 not exposed to light remain as it is on the developer roller 2, is further transported to the nip between the developer roller 2 and the feeding roller 5, and is reused. Images are formed through a series of motions as described above.

Here, the change in surface tension of the developer 20 need not be reversible. Almost all of the developer 20 having changed in surface tension is transferred to the recording material 8, and a small quantity of the developer 20 remains on the image forming drum 3 without being transferred. The latter is removed by the cleaning roller 10 and discarded.

A first embodiment of the process through which the surface tension of the developer 20 changes whereby the developer 20 is selectively transferred to the image forming drum 3 will be described below with reference to FIGS. 2 and 3.

Figure 2:
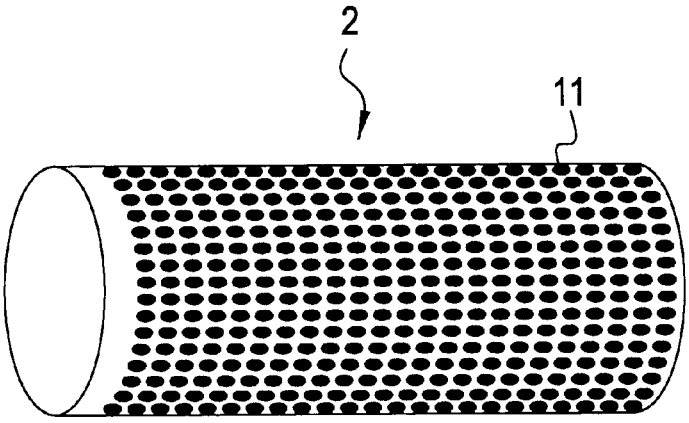
FIG. 2 is a perspective view of a developing roller.

As shown in FIG. 2, a porous structure is formed on the surface of the developer roller 2, and the developer 20 is dividedly held in the micropores 11 formed on the surface.

Figures 3A, 3B, 3C:
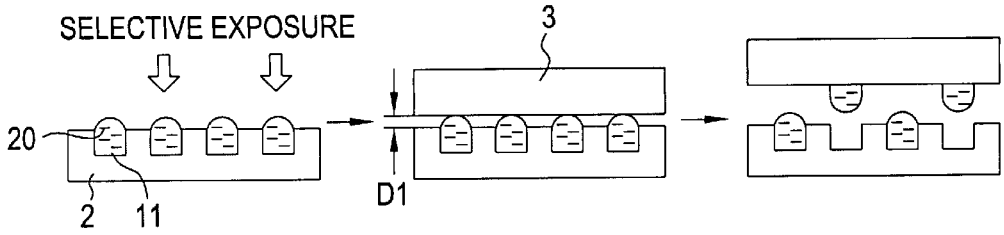
FIG. 3(*a*), FIG. 3(*b*) and FIG. 3(*c*) illustrate a first embodiment of a process by which a developer is selectively made to adhere to an image forming drum.

FIG. 3(*a*), FIG. 3(*b*) and FIG. 3(*c*) how the developer 20 selectively adheres to the image forming drum 3, and diagrammatically show the nip between the micropores 11 and the image forming drum 3. Here, a gap D1 between the developer roller 2 and the image forming drum 3 is adjusted to a proper value. The surface of the developer roller 2 is formed of a hydrophilic material as exemplified by aluminum or brass. The surface of the image forming drum 3 is formed of a hydrophobic material as exemplified by fluorine resin. Accordingly, when the developer 20 is hydrophilic, it tends to adhere to the developer roller 2, and, when inversely the developer 20 is hydrophobic, it tends to adhere to the image forming drum 3.

Figure 4:
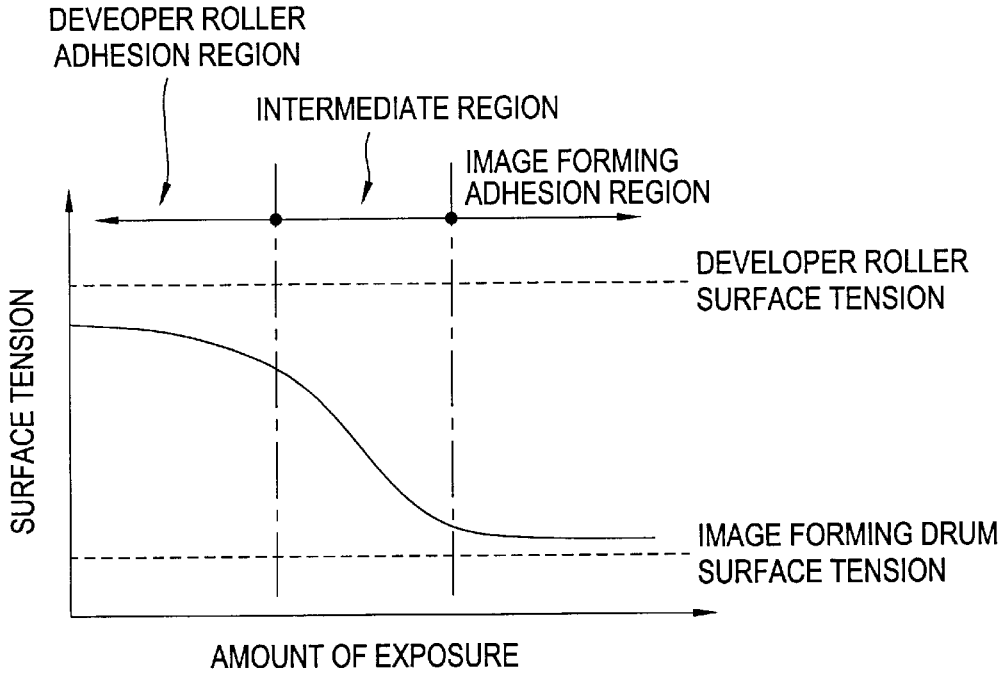
FIG. 4 is a graph showing the relationship between the amount of exposure and the surface tension of the developer.

The phenomenon of selective adhesion will be described here, taking an example in which the developer 20 is so designed as to decrease in surface tension upon exposure to light. FIG. 4 shows the relationship between the amount of exposure and the surface tension of the developer 20. At the initial stage, the developer 20 has a molecular structure exhibiting a hydrophilicity and has a surface tension close to that of water which is about 75 dynes/cm. Here, since the developer 20 is hydrophilic, the developer 20 tends to adhere thereto by the aid of affinity. However, since the surface of the image forming drum 3 is hydrophobic and also has a surface tension of as low as about 20 dynes/cm, the developer 20 does not adhere thereto. However, upon exposure of the developer 20 to light, the developer 20 turns hydrophobic and comes to have a low surface tension of about 25 dynes/cm, which is a value close to the surface tension of the image forming drum 3. Also, once the developer 20 turns hydrophobic, its affinity for the developer roller 2 comes to a negligible degree, and hence the developer 20 comes to more tend to adhere to the image forming drum 3 than to the developer roller 2.

Thus, the conversion from hydrophilic to hydrophobic or the conversion from hydrophobic to hydrophilic can be made by selectively changing the surface tension upon exposure of the developer 20 to light. Hence, only the developer 20 having turned hydrophobic can be selectively made to adhere to the image forming drum 3 to form an image thereon. Of course, it is also possible to form the surface of the developer roller 2 using a hydrophobic material and also to form the surface of the image forming drum 3 using a hydrophilic material so that only the hydrophilic developer 20 can be selectively made to adhere.

Figures 5A, 5B, 5C:
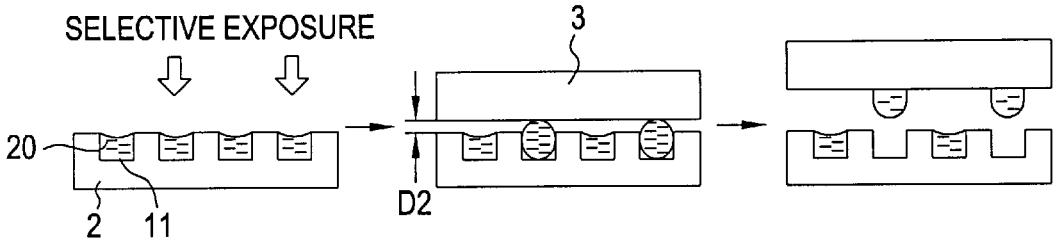
FIG. 5(*a*), FIG. 5(*b*) and FIG. 5(*c*) illustrate a second embodiment of the process by which a developer is selectively made to adhere to an image forming drum.

A second embodiment of the process through which the surface tension of the developer 20 changes whereby the developer 20 is selectively transferred to the image forming drum 3 will be described below with reference to FIGS. 2 and 5(*a*), 5(*b*) and 5(*c*).

The surface of the developer roller 2 has the same form as the first embodiment, where, as shown in FIG. 2, a porous structure is formed thereon, and the developer 20 is dividedly held in the micropores 11 formed on the surface. In this second embodiment, as shown in FIG. 5(*a*), FIG. 5(*b*) and FIG. 5(*c*), a phenomenon in which the droplets come to have shapes closer to spheres with an in crease in contact angles is utilized so that only the developer 20 having changed in surface tension comes into contact with the image forming drum 3.

Here, for example, assuming an instance where the developer 20 changes in surface tension to change from hydrophobic to hydrophilic, this can be attained by setting the surface of the developer roller 2 hydrophobic and the surface of the image forming drum 3 hydrophilic. More specifically, when not exposed to light, the developer 20 stands hydrophobic, and hence the developer 20 run through all the micropores 11 and its liquid level is maintained at a low level. However, once exposed to light, the developer 20 changes in surface tension to have a large contact angle to the hydrophilic surface, so that the droplets of the developer 20 in the micropores 11 come to have a shape closer to spheres and the liquid level becomes higher. Here, it is possible to adjust a gap D2 between the developer roller 2 and the image forming drum 3 to a proper value so that the developer 20 does not come into contact with the image forming drum 3 when the liquid level is low and the developer 20 comes into contact with the image forming drum 3 when the liquid level is high. The developer 20 exposed to light and having come into contact with the image forming drum 3 adheres to the image forming drum 3 as it is, since the surface of the image forming drum 3 is hydrophilic.

When constituted as described above, only the developer 20 exposed to light can selectively adhere to the image forming drum 3 to form an image. Of course, using a developer 20 capable of changing from hydrophilic to hydrophobic, it is also possible to set the surface of the developer roller 2 hydrophilic and the surface of the image forming drum 3 hydrophobic so that only the developer 20 having turned hydrophobic can selectively adhere to the image forming drum 3. In this second embodiment, the developer 20 does not come into contact with the image forming drum 3 at all at non-image areas, and hence there is an advantage that no stain or contamination occurs at the non-image areas.

Figures 6A, 6B:
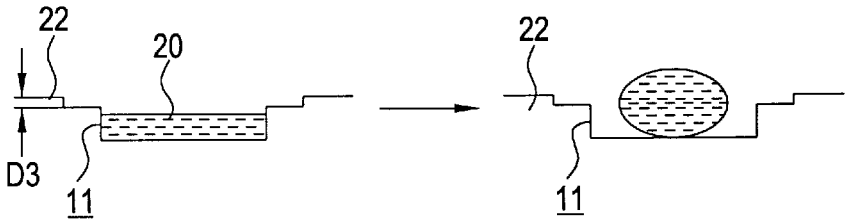
FIG. 6(*a*) and FIG. 6(*b*) are enlarged views of micropores provided with projections on their circumferences.

In the second embodiment described above, as shown in FIG. 6(*a*) and FIG. 6(*b*), projections 22 may be provided on the circumferences of the individual micropores 11 of the developer roller 2 so that the developer 20 whose droplets have not changed in shape does not adhere to the image forming drum 3 even when the developer roller 2 is brought into contact with it. More specifically, it is possible to adjust a gap D3 between the developer roller 2 and the uppermost portions of the micropores 11 to a proper value so that the developer 20 does not come into contact with the image forming drum 3 when the liquid level is low and the developer 20 comes into contact with the image forming drum 3 when the liquid level is high. This constitution makes it unnecessary to strictly adjust the gap D2 between the developer roller 2 and the image forming drum 3 because these may be brought into contact with each other.

Figure 7A:
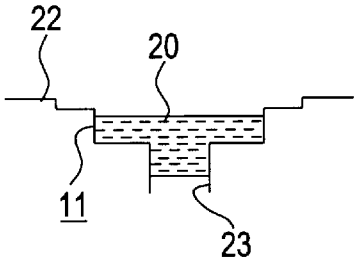
FIG. 7(*a*) and FIG. 7(*b*) are enlarged views of micropores having through-hole structure.
Figure 7B:
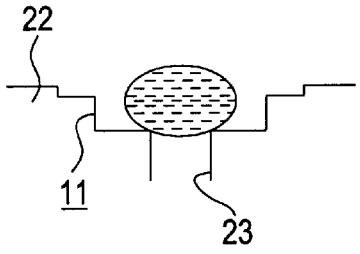

As also shown in FIG. 7(*a*) and FIG. 7(*b*), the micropores may be provided in the form of through-holes so that the developer 20 can be held in the micropores 11 in a sufficient liquid quantity without being obstructed by air bubbles.

Figure 8A:
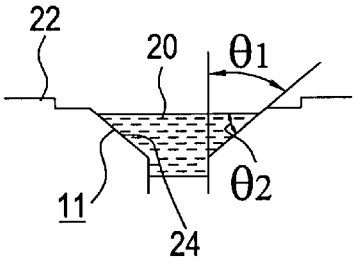
FIG. 8(*a*) and FIG. 8(*b*) are enlarged views of micropores having tapered structure.
Figure 8B:
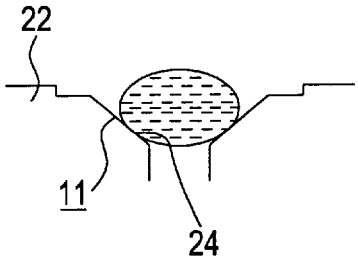

As shown in FIG. 8(*a*) and FIG. 8(*b*), the micropores 11 may be formed in the form of tapered-holes expanded on their surface side so that the change in liquid level caused by the change in contact angles can be utilized in a good efficiency. More specifically, in the state the developer 20 has a small contact angle, an angle θ 1 of a tapered portion 24 may be so set as to be an angle from which a contact angle θ 2 is subtracted, so that the liquid level becomes flat. Here, cosines of changes in angles of the contact angle correspond to changes in height of the liquid level, and hence the rate of change in height of the liquid level with respect to the rate of change in the contact angle can be made much larger.

Figure 9:
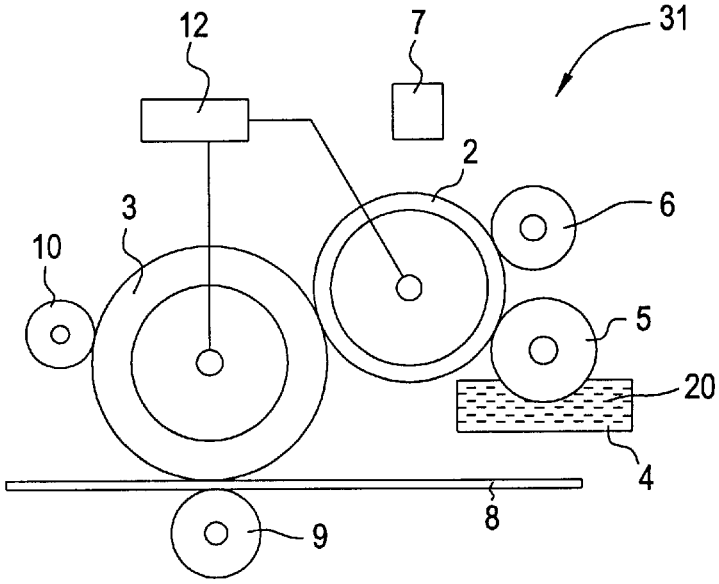
FIG. 9 schematically illustrates the constitution of an image forming apparatus having an electric-field applying member.

When the rate of change in height of the liquid level is not enough to cause the selective adhesion, an electric-field applying member 12 may be provided as in an image forming apparatus 31 shown in FIG. 9, and an electric field may be applied across the developer roller 2 and the image forming drum 3 so that the selective adhesion can be assisted. When such an electric field is applied, the developer 20 undergoes an electrostatic attraction force, and the liquid level becomes readily changeable on the whole. Hence, even a slight change in the liquid level causes the electric field to concentrate at that area, so that the change in the liquid level is amplified. For this voltage, a voltage of about 100 V can be enough, and the high voltage of several kV as used in eleotrophotography is not required. Incidentally, the electric-field applying member 12 constitutes the electric-field applying means in the present invention.

Figure 10:
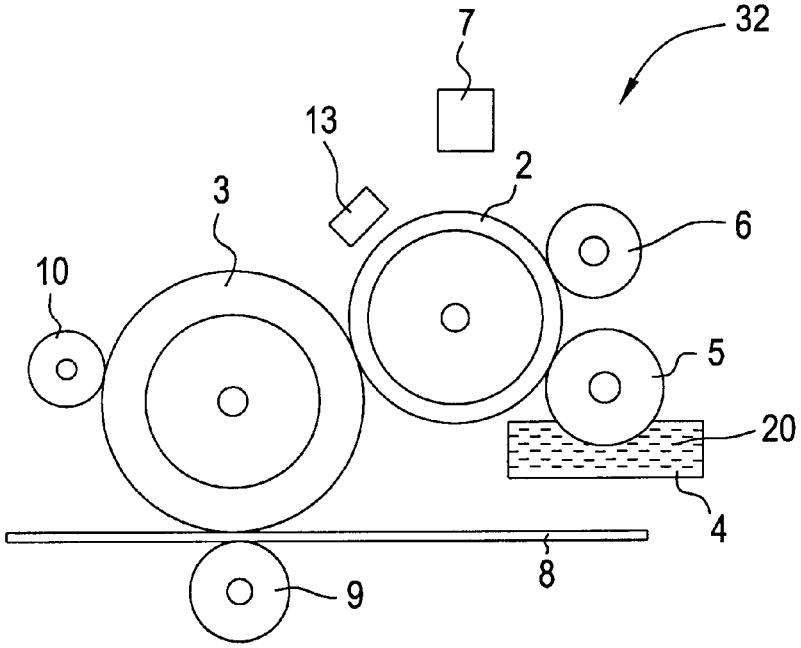
FIG. 10 schematically illustrates the constitution of an image forming apparatus having a warm member.

As in an image forming apparatus shown in FIG. 10, a warm member 13 such as a heater for keeping the surface of the developer roller 2 at a preset temperature may also be provided in proximity to the surface of the developer roller 2 so that the developer 20 can have a temperature suited for causing the shape of droplets to change, whereby the reaction by which the surface tension changes can be accelerated. In this instance, the preset temperature is a temperature within the range in which the shape of droplets of the developer 20 does not change. and must be set at a temperature that may readily cause the shape of droplets to change. This warm member 13 makes it possible for the developer 20 to surely cause the change in surface tension. Incidentally, the warm member 13 constitutes the warm means in the present invention.

The developer 20 is divided by the micropores 11, and the developer 20 in the individual micropores 11 can independently come into contact with the image forming drum 3. Hence, the developer 20 in some micropores 11 is not affected by the developer 20 in other micropores 11, so that only the developer 20 having changed in surface tension can selectively adhere to the surface of the image forming drum 3. According to this constitution, the image resolution can be made higher correspondingly as the micropores 11 are formed in a smaller pitch. In general, in order to print character data or image data on printers, the micropores 11 may preferably have a diameter of 100 $\mu$m or smaller. Taking account of the fact that the micropores 11 has also the function to hold the developer 20, the developer 20 can not be held in a sufficient quantity unless the micropores 11 have a diameter of 1 $\mu$m or larger. Similarly, in order to control the developer 20 so as to be held in the micropores 11 in a proper quantity, the micropores 11 may preferably have a depth of from about 1 to 100 $\mu$m. More specifically, if they have a depth of 100 $\mu$m or more, the quantity of the developer 20 per dot may be so excessively large that the feathering may occur in a high possibility, to cause a deterioration of resolution. On the other hand, if the micropores 11 has a depth of 1 $\mu$m or less, the developer 20 can not be held therein in a sufficient quantity.

Methods for forming the micropores 11 on the developer roller 2 will be described below. As methods for forming the micropores, some methods as shown below are available.

A first method is a method of forming them by photo-electroforming. The photo-electroforming is a process comprising coating a photoresist on the surface of a substrate to be treated, thereafter exposing the photoresist at its exposed areas, and further selectively plating only the areas from which the photoresist has been removed. According to this process, areas other than the micropores can be plated with a hydrophilic metal, and consequently the micropores can be formed in a good precision. In this process, the surface of the developer roller 2 may be directly plated, or micropores may be previously formed on the surface of a sheet-like metal and the resultant sheet-like metal may be secured to the surface of the developer roller 2.

A second method is a method of forming the micropores by etching. In this method, a substrate of the developer roller 2 is formed using a hydrophilic metal, and the metal surface is selectively etched using a photoresist to form the micropores.

A third method is a method of forming the micropores by sandblasting. According to this method, a substrate of the developer roller 2 is subjected to sandblasting to thereby scrape only the part of micropores. This method has an advantage that the micropores can be formed in a short time.

A fourth method is a method of providing the micropores by winding a mesh sheet around a substrate of the developer roller 2. Here, the mesh size is set in accordance with the desired resolution. Here, the mesh sheet may be prepared using a hydrophobic resin such as polystyrene, or a hydrophilic material such as stainless steel. A sheet prepared by monolithic molding, free of weave patterns is preferred because the developer can be divided perfectly for each dot.

A fifth method is a method of printing a pattern on a substrate of the developer roller 2 so as to form a suitable porous pattern. As a hydrophobic coating material, a coating material containing, e.g., silicone resin may be used, and the pattern may preferably be printed by screen printing in a desired thickness.

A sixth method is a method in which the surface of a developer roller formed of a hydrophilic material is irradiated with laser light or electron beams to form micropores.

A seventh method is a method in which the micropores are formed by molding using a mold prepared beforehand. The mold may be prepared beforehand by electrical discharge machining or laser processing. The molding may be carried out by injection molding or sinter molding, which may be used in accordance with the material of the substrate of the developer roller 2. According to this method, the micropores can be formed stably and in a good efficiency.

An eighth method is a method in which the micropores are formed by punching, using a mold prepared in the same manner as in the seventh method.

Using any of the methods described above, the developer roller 2 having the micropores 11 with the desired size can be prepared.

As described above, the developer 20 undergoes the change in surface tension by the process according to the first embodiment or second embodiment, to selectively adhere to the surface of the image forming drum 3 to form an image.

The principle of how the developer changes in surface tension upon exposure will be explained below. The mechanism by which the surface tension changes upon exposure can be considered in some ways.

Figure 11A:
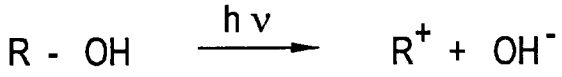
FIG. 11(*a*) and FIG. 11(*b*) illustrate a phenomenon of change in steric configuration of molecules.
Figure 11B:
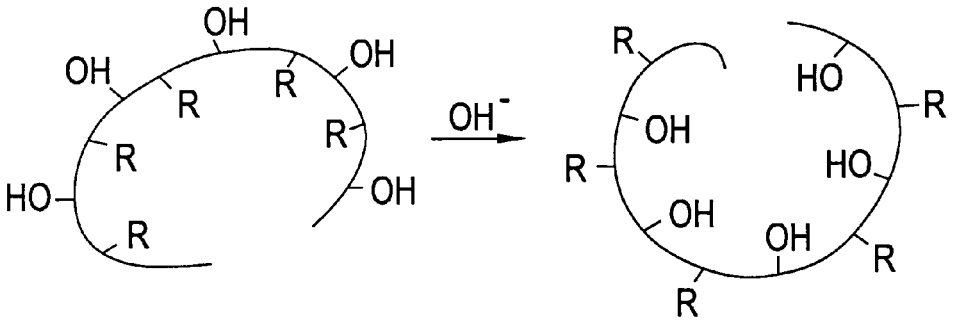

At the outset, a first example will be described with reference to FIGS. 11(*a*) and 11(*b*). FIG. 11(*a*) and FIG. 11(*b*) illustrate a developer whose steric configuration of molecules changes upon exposure to cause the change in surface tension.

The developer of the first example is a water-based liquid composed chiefly of a compound A whose hydroxyl groups separate upon exposure and a polymer B whose structure changes upon a change in pH.

The compound A separates hydroxyl groups upon exposure [FIG. 11(*a*)]. Upon separation of hydroxyl groups, the equilibrium condition changes in such way as to result in an increase in pH of the whole developer.

The polymer B has a structure having acidic hydrophilic groups and hydrophobic groups. When the pH is in a small value, it has a structure wherein all the hydrophilic groups face outward and all the hydrophobic groups face inward, a group of hydrophilic groups enveloping a group of hydrophobic groups [FIG. 11(*b*), left ]. In such a condition, the polymer B is rendered hydrophilic, and, under the influence thereof, the whole developer comes to have a surface tension close to that of water. On the other hand, when the pH is in a large value, the polymer B comes into a condition where all the hydrophilic groups face inward and all the hydrophobic groups face outward [FIG. 11(*b*), right]. This is because, in a neutral condition, this polymer B is originally so designed as to be stabler when it is in the latter condition.

More specifically, it is presumed that the hydrophilic group side, which has been made to face outward while it stands twisted, so to speak, under the influence of the acidic hydrophilic groups when the pH is in a small value, comes close to a neutral condition after the pH comes to a large value, whereupon the polymer B molecules cause a deformation of structure to return to a stable condition where the hydrophobic groups face outward. In the condition where all the hydrophilic groups face inward and all the hydrophobic groups face outward, the polymer B is rendered hydrophobic, and, under the influence thereof, the whole developer comes to have a surface tension close to that of organic solvents.

Examples of the compound A and polymer B are shown below by Formulas (1) and (2), respectively.

Formula (1)

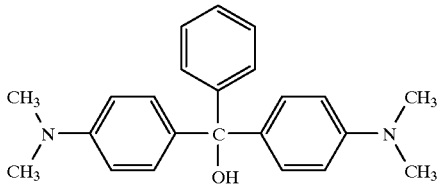

Formula (2)

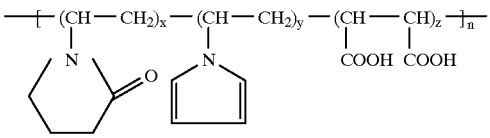

The compound of Formula (1) is known as a material that undergoes photo-separation, and is a leuco compound of triphenylmethane. The leuco compound of triphenylmethane separates into triphenyl methyl cations and anions (hydroxyl ions) upon absorption of light. The polymer B of Formula (2) is a polymer that changes from hydrophilic to hydrophobic upon increase in pH, and has hydrophilic groups and hydrophobic groups in the side chain. It can be produced in the following way.

First, in an atmosphere of argon, maleic anhydride, N-vinylpyrrolidone and vinylimidazole are mixed in a molar ratio of 1:2:2 in water. As a polymerization initiator, azobisisobutyronitrile is further added, and the temperature is kept at 65° C. for 48 hours with stirring. Then, after the resultant mixture is cooled, water is added so that the polymer is in a weight ratio of 50%. Thus, the polymer B is produced.

The compound A is mixed in an aqueous solution of the polymer thus made up. Thus, the developer that changes in contact angle upon exposure is obtained.

The change in surface tension of the developer thus produced was measured to confirm that its surface tension was shown as about 75 dynes/cm before exposure, whereas it lowered to about 20 dynes/cm upon exposure. Accordingly, it was confirmed that its contact angle to, e.g., glass changed from 20 degrees to 95 degrees. This change in surface tension is a sufficient change utilized in the image forming apparatus 1.

A second example will be described below. This example is the instance where the cis-trans rearrangement takes place to cause a change in surface tension upon exposure to light.

Figure 12:
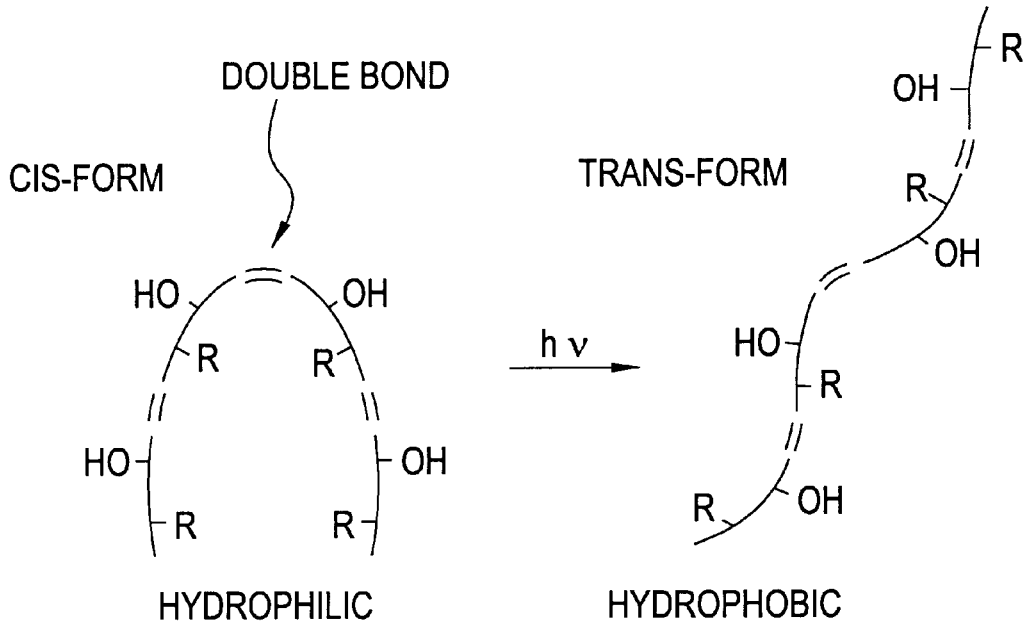
FIG. 12 illustrates a phenomenon of change in steric configuration of molecules.

FIG. 12 illustrates how the steric configuration of molecules changes as a result of cis-trans rearrangement. The developer is a developer prepared by dispersing a compound C in water. The compound C has a cis-form before exposure, and has such a structure that it has a group of hydrophilic groups outside and a group of hydrophobic groups inside (FIG. 12, left). This structure stands metastable because of hydrogen bonds. Upon exposure to light, the cis-trans rearrangement is induced here, and the polymer turns into a trans-form, which is a stabler condition (FIG. 12, right). As a result of such a structural change, like the first example, the surface tension changes from the one standing close to that of water to the one standing close to that of organic solvents. Thus, the same change in contact angles as in the first example takes place. Here, an example of the compound C is represented by Formula (3).

Formula (3)

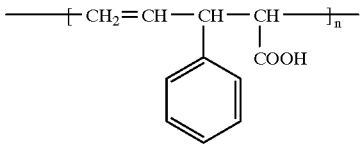

Since the cis-trans rearrangement is a reversible reaction, it is also possible to change a hydrophobic condition where the surface tension is small, set as an initial condition, to a hydrophilic condition where the surface tension is great.

Besides, it is possible to utilize a change in surface tension by a change in molecular structure caused by photocrosslinklng. It is also possible to utilize a change in surface tension by a change in molecular structure caused by photopolymerization.

Using the developer as described, the image forming apparatus according to the present embodiment can make the developer selectively adhere to the surface of the image forming drum 3 to form an image.

Since the image forming apparatus 1 is so constituted that only the developer having changed in surface tension selectively adheres to image forming areas, the change in surface tension of the developer need not be reversible. Hence, materials can be selected over so wide a range that it is highly possible that materials suited in view of properties and also from an industrial viewpoint can be selected. In addition, since the developer is used up as an article for consumption, it is unnecessary to worry about any deterioration due to repeated used, and a very highly reliable system can be set up. Moreover, since the reaction by which the surface tension changes takes place at a very high rate, it is possible to make the printing speed of the entire system as speedy as that of offset printing. Also, since the liquid developer is used, it is possible to obtain images with a vivid color and a high minuteness. Furthermore, since the developer used can be a water-based one, no problem may occur at all in view of environment.

The present invention is by no means limited to the embodiments described above in detail, and can be variously modified within the range not deviating from the purport of the present invention.

Figure 13:
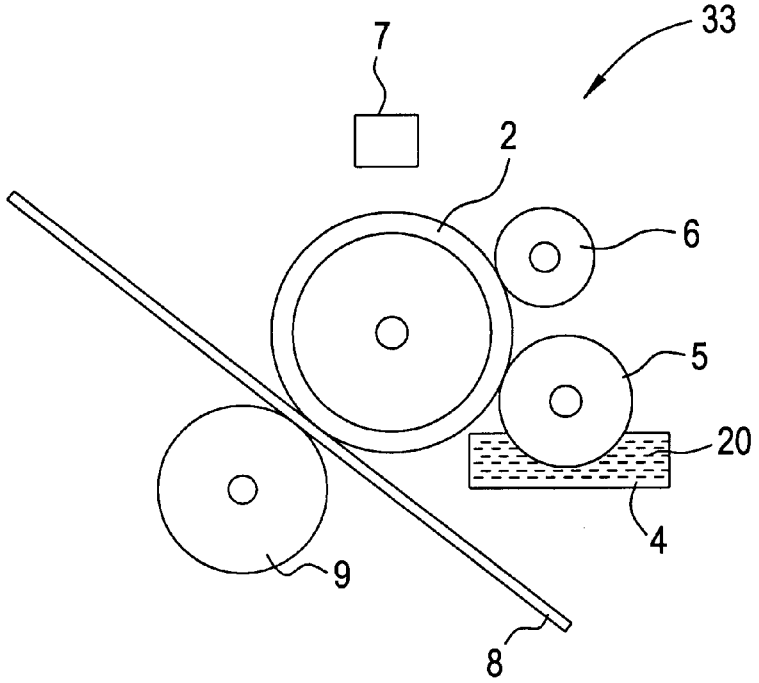
FIG. 13 schematically illustrates the constitution of an example of modification of the image forming apparatus.

For example, in the embodiments described above, the system is so constituted that the latent image on the developer roller 2 is once transferred to the surface of the image forming drum 3 and then further transferred to the recording material 8. However, as in an image forming apparatus 33 shown in FIG. 13, the system may be so constituted that the developer roller 2 and the recording material 8 come into direct proximity so that only the developer having changed in surface tension can be selectively made to adhere thereto from the developer roller 2. In this instance, it follows that the recording material 8 serves also as an image forming member and the image on this recording material 8 is a final output. This constitution makes it unnecessary to provide the image forming drum 3 and the cleaning roller 10, and the system can be made much simpler.

Figure 14:
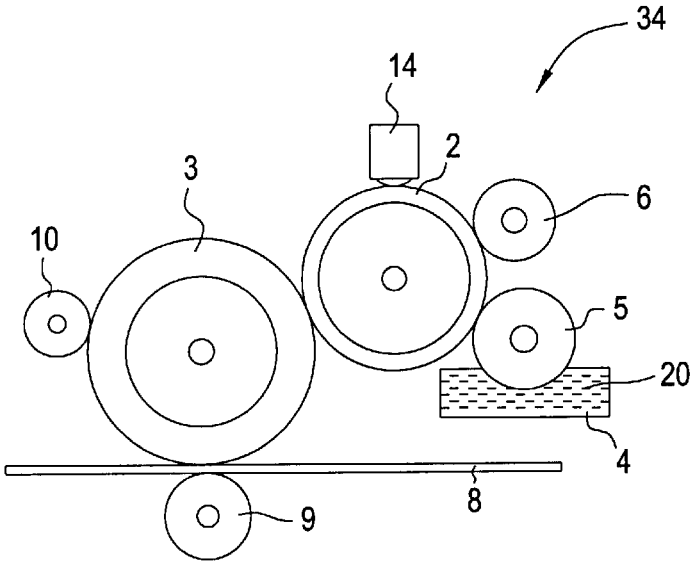
FIG. 14 schematically illustrates the constitution of another example of modification of the image forming apparatus.
Figure 15A:
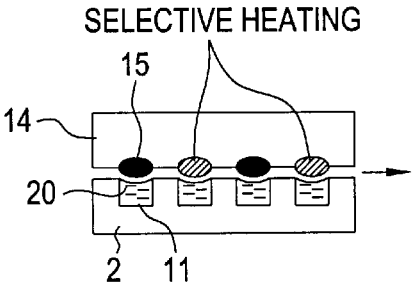
FIG. 15(*a*), FIG. 15(*b*) and FIG. 15(*c*) are enlarged views of heating areas in a modification example of the image forming apparatus.
Figure 15B:
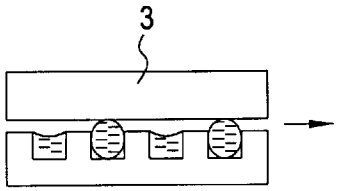
Figure 15C:
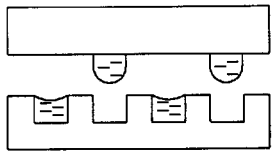

In the embodiments described above, the developer capable of changing in surface tension upon exposure to light is used. It is also possible to use a developer capable of changing in surface tension upon heating. In this instance, as in an image forming apparatus 34 shown in FIG. 14, a selective heater 14 that performs selective heating in accordance with image information must be provided in place of the selective exposure device 7. For example, as the selective heater 14, a thermal head may be used which is used in thermal printers. FIG. 15(*a*), FIG. 15(*b*) and FIG. 15(*c*) show an enlarged portion of a zone where the developer is heated by the selective heater 14. The selective heater 14 is constituted of numerous heating elements 15 arranged at certain intervals in proximity to the developer. As the developer 20, a liquid may be used which contain the polymer 2 of Formula (2) previously described and a compound D represented by Formula (4) which is known to generate an acid upon heating.

Formula (4)

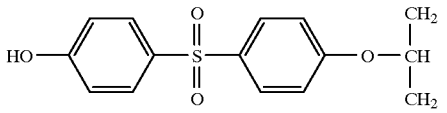

In this embodiment, the compound D generates hydrogen ions when heated, to make the pH lower. Hence, in reverse to the embodiments previously described, the polymer B changes from hydrophobic to hydrophilia, so that the developer can selectively adhere to the image forming drum 3 to form an image.

The entire disclosure of Japanese Patent Application No. 8-310767 filed on Nov. 21, 1996 including the specification, claims, summary and drawings is hereby incorporated by reference.

What is claimed is:

1. An image forming method comprising;

feeding a liquid developer capable of changing in surface tension upon exposure or heating, to the surface of a developer holding member;

forming a latent image on the surface of the developer holding member on which the liquid developer is held, by subjecting the surface to selective exposure or heating in accordance with image information;

transferring the latent image on an image forming member to form a positive image; and transferring the positive image to a recording medium to form a visible image.

2. The image forming method according to claim 1, wherein said liquid developer contains a component capable of causing a change in steric configuration of molecules upon exposure or heating.

3. The image forming method according to claim 1, wherein said liquid developer contains a component capable of releasing hydroxide ions or hydrogen ions to cause a change in pH upon exposure or heating and a component capable of changing in surface tension as a result of the change in pH.

4. The image forming method according to claim 1, wherein said liquid developer contains a component capable of cis-trans rearrangement to cause a change in surface tension upon exposure or heating.

5. An image forming apparatus comprising;

a developer holding member on the surface of which is held a liquid developer capable of changing in surface tension upon exposure or heating;

a liquid developer feeding member for feeding the liquid developer to the surface of the developer holding member;

a latent image forming member for forming a latent image on the surface of the developer holding member on which the liquid developer is held, by subjecting the surface to selective exposure or heating in accordance with image information;

a transfer member for transferring the latent image on an image forming member to form a positive image; and a transfer member for transferring the positive image to a recording medium to form a visible image.

6. The image forming apparatus according to claim 5, wherein said latent image forming member is so constituted as to cause a change in surface tension of the liquid developer held on the surface of the developer holding member, to change the shape of droplets.

7. The image forming apparatus according to claim 5, wherein said transfer member has an intermediate transfer member provided between said developer holding member and said recording medium, disposed so as to come into contact with or come near to the surface of said developer holding member, and is so constituted as to receive as an intermediate transfer image the latent image formed on the surface of said developer holding member and to transfer the received intermediate transfer image to said recording medium.

8. The image forming apparatus according to claim 7, wherein said developer holding member and said intermediate transfer member are formed of materials having different surface tension from each other at their surface portions.

9. The image forming apparatus according to claim 7, which further comprises an electric-field applying member for applying an electric field across said developer holding member and said intermediate transfer member.

10. The image forming apparatus according to claim 5, wherein numerous micropores in which said liquid developer is holdable is formed on the surface of said developer holding member.

11. The image forming apparatus according to claim 10, wherein said developer holding member is provided with a projection for forming a space that keeps a certain distance between the liquid surface of said liquid developer held in the micropores and the surface of said developer holding member.

12. The image forming apparatus according to claim 10, wherein said numerous micropores are formed in the form of through-holes.

13. The image forming apparatus according to claim 10, wherein said numerous micropores are formed in the form of tapered-holes expanded on their surface side.

14. The image forming apparatus according to claim 10, which further comprises a warm means for keeping the temperature of said liquid developer held on the surface of said developer holding member may be provided.

15. The image forming apparatus according to claim 5, wherein said latent image forming member comprises an exposure member so constituted as to selectively expose the surface of said developer holding member in accordance with image information.

16. The image forming apparatus according to claim 15, wherein said exposure member comprises a laser light scanning device that scan with laser light.

17. The image forming apparatus according to claim 15, wherein said exposure member comprises a light-emitting diode line head with numerous light-emitting diodes arranged in lines.

18. The image forming apparatus according to claim 15, wherein said exposure member comprises a liquid-crystal shutter and a back light for liquid crystal.

19. The image forming apparatus according to claim 15, wherein said latent image forming member comprises a heating member for selectively heating the surface of said developer holding member in accordance with image information.

20. The image forming apparatus according to claim 19, wherein said heating member comprises a thermal head.

* * * * *